US008240662B2

(12) United States Patent
Yahata

(10) Patent No.: US 8,240,662 B2
(45) Date of Patent: Aug. 14, 2012

(54) SHEET FINISHING APPARATUS OF IMAGE FORMING APPARATUS

(75) Inventor: Isao Yahata, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 169 days.

(21) Appl. No.: 12/774,887

(22) Filed: May 6, 2010

(65) Prior Publication Data

US 2010/0289213 A1 Nov. 18, 2010

Related U.S. Application Data

(60) Provisional application No. 61/178,393, filed on May 14, 2009, provisional application No. 61/178,434, filed on May 14, 2009.

(51) Int. Cl.
*B65H 31/00* (2006.01)

(52) U.S. Cl. ..... 271/207; 271/213; 271/214

(58) Field of Classification Search ..... 271/145, 271/162, 164, 207, 213, 314
See application file for complete search history.

(56) References Cited

U.S. PATENT DOCUMENTS 6,695,303 B2 * 2/2004 Okada et al. ..... 271/9.12
7,931,267 B2 * 4/2011 Kajiyama ..... 271/164

FOREIGN PATENT DOCUMENTS

JP 2000-044107 2/2000
JP 2000044107 A * 2/2000

* cited by examiner

*Primary Examiner* — Michael McCullough
(74) *Attorney, Agent, or Firm* — Patterson & Sheridan, LLP

(57) ABSTRACT

A sheet finishing apparatus includes a conveyance section which is disposed in a space section which is surrounded by peripheral walls of an image forming apparatus main body and conveys a recording medium discharged from the image forming apparatus in a paper discharge direction, a frame which is positioned in the space section and contains the conveyance section, and a removal mechanism to bring the conveyance section into a removal mode in synchronization with an operation of extracting the frame from the space section.

15 Claims, 7 Drawing Sheets

SHEET FINISHING APPARATUS OF IMAGE FORMING APPARATUS

CROSS-REFERENCE TO RELATED APPLICATION

This application is based upon and claims the benefit of priority from Provisional U.S. Applications 61/178,393 filed on May 14, 2009 and 61/178,434 filed on May 14, 2009, the entire contents of which are incorporated herein by reference.

TECHNICAL FIELD

Embodiments described herein relates generally to a sheet finishing apparatus for finishing a sheet on which an image is formed by an image forming apparatus such as a copying machine or an MFP (Multi-Functional Peripheral).

BACKGROUND

There is an apparatus in which a sheet finishing apparatus is installed in a space provided in a main body of an image forming apparatus. When the sheet finishing apparatus is disposed in the space of the image forming apparatus, since the space of the image forming apparatus is narrow, there is a fear that an operation of taking out a sheet from a storage tray is difficult or an operation of removing a sheet jam generated in the sheet finishing apparatus is difficult.

Thus, it is desired to develop a sheet finishing apparatus in which the operability of and maintenance by an operator for the sheet finishing apparatus disposed in the space of an image forming apparatus is improved.

DETAILED DESCRIPTION

According to an embodiment, a sheet finishing apparatus includes a conveyance section which is disposed in a space section which is surrounded by peripheral walls of an image forming apparatus main body and conveys a recording medium discharged from the image forming apparatus in a paper discharge direction, a frame which is positioned in the space section and contains the conveyance section, and a removal mechanism to bring the conveyance section into a removal mode in synchronization with an operation of extracting the frame from the space section.

Figure 1:
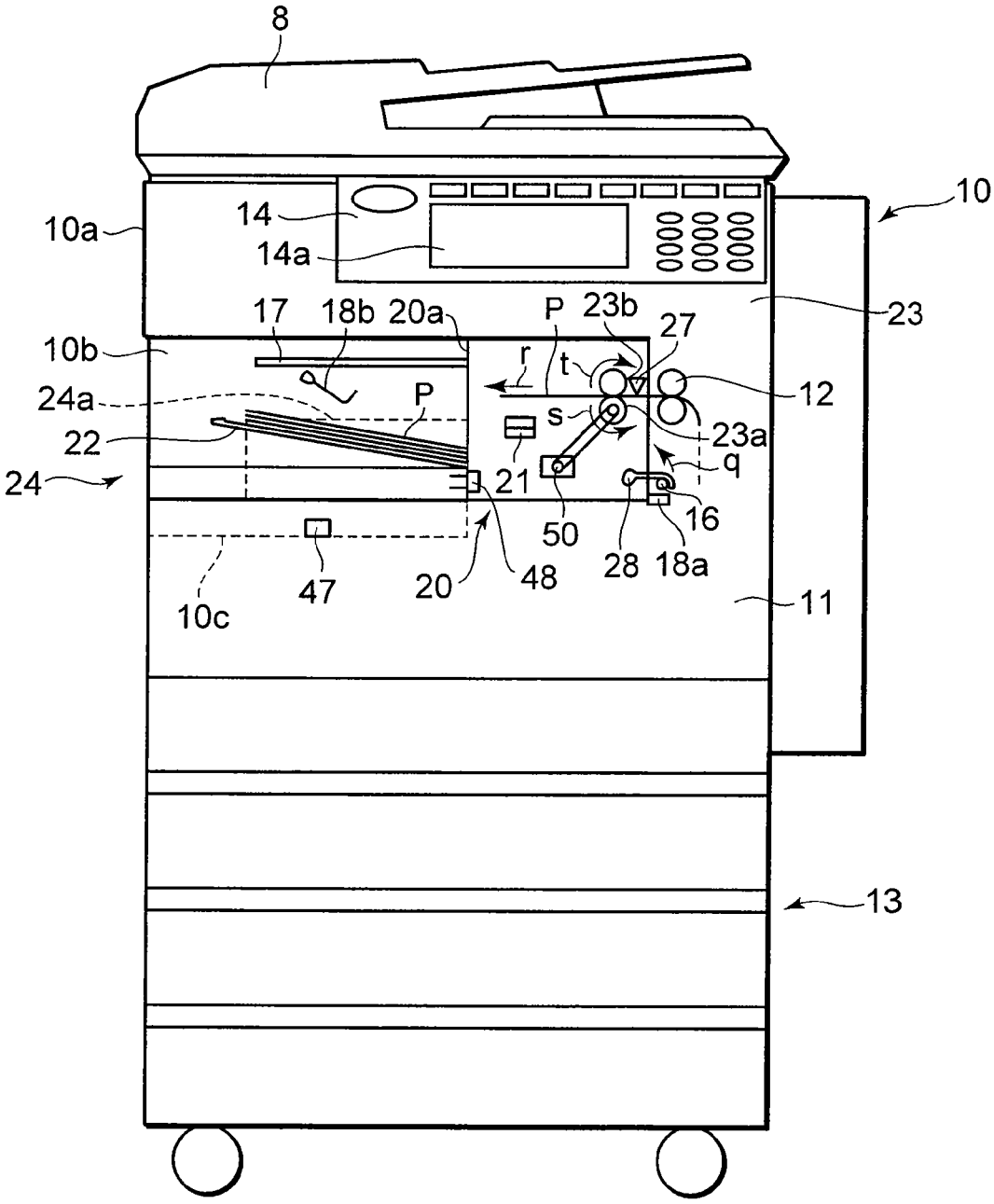
FIG. 1 is a schematic front view showing a sheet finishing apparatus disposed in an MFP according to a first embodiment.
Figure 8:
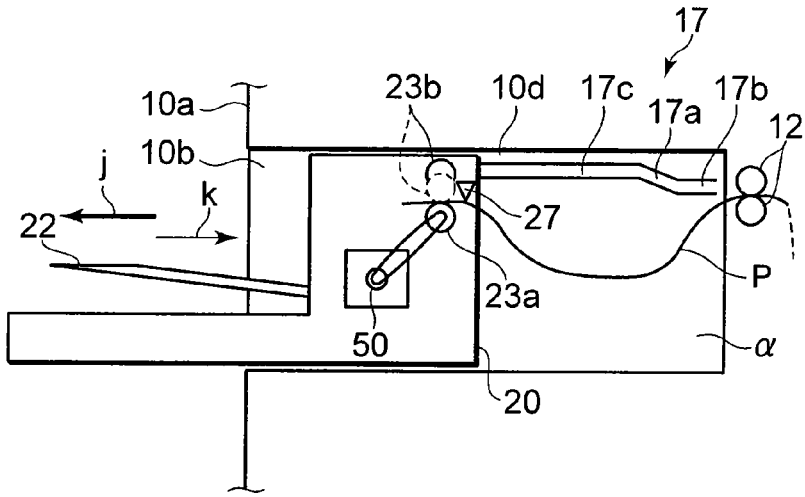
FIG. 8 is a schematic explanatory view showing a state where the finisher according to the first embodiment is extracted.

Hereinafter, a first embodiment will be described. FIG. 1 is a schematic explanatory view showing the arrangement of a finisher 20 as a sheet finishing apparatus connected to an MFP 10 as an image forming apparatus of a first embodiment. The finisher 20 is positioned in a space section 10*b* provided in a main frame 10*a* of the MFP 10 including a scanner 8. In the MFP 10, a printer section 11 prints an image on a sheet P as a recording medium fed from a sheet feed section 13, and discharges the sheet P to a finisher 20 from a paper discharge roller 12. The MFP 10 includes a control panel 14 having a display panel 14*a* above the printer section 11. A groove cam 17 as a guide rail constituting a removal mechanism is provided in a rear side inner wall 10*d* of the space section 10*b* in the main frame 10*a*. As shown in FIG. 8, the groove cam 17 has a step between a lower stage 17*b* and an upper stage 17*c* through a slope 17*a*.

The finisher 20 is fixed such that for example, a connection lever 28 is hooked to a boss 16 formed in the MFP 10, and a frame 20*a* is connected to the main frame 10*a*. The connection lever 28 is rotated in an arrow q direction to release the connection between the main frame 10*a* and the frame 20*a*. The MFP 10 includes a finisher sensor 18*a* to detect installation of the finisher 20 at the rear side.

The finisher 20 includes, for example, a stapler 21 for stapling sheets as a finishing process. The finisher 20 includes a pinch roller pair 23 as a conveyance section to pinch the sheet P discharged from the paper discharge roller 12 and to convey it in an arrow r direction as a paper discharge direction toward a storage tray 22. The finisher 20 includes a sheet sensor 27 as a detection section to detect a sheet jam. After the sheet sensor 27 is turned on by the arrival of the sheet P, when the trailing edge of the sheet P does not pass and the sensor is not turned off, the sensor detects that a sheet jam occurs. The MFP 10 includes a full state detection sensor 18*b* which is disposed above the storage tray 22 and detects the full state.

A first motor 50 of the finisher 20 rotates the pinch roller pair 23 in the paper discharge direction. The first motor 50 rotates a lower pinch roller 23*a* in an arrow s direction as the rotation in the paper discharge direction. An upper pinch roller 23*b* driven with the sheet P traveling in the arrow r direction and rotates in an arrow t direction.

Figure 2:
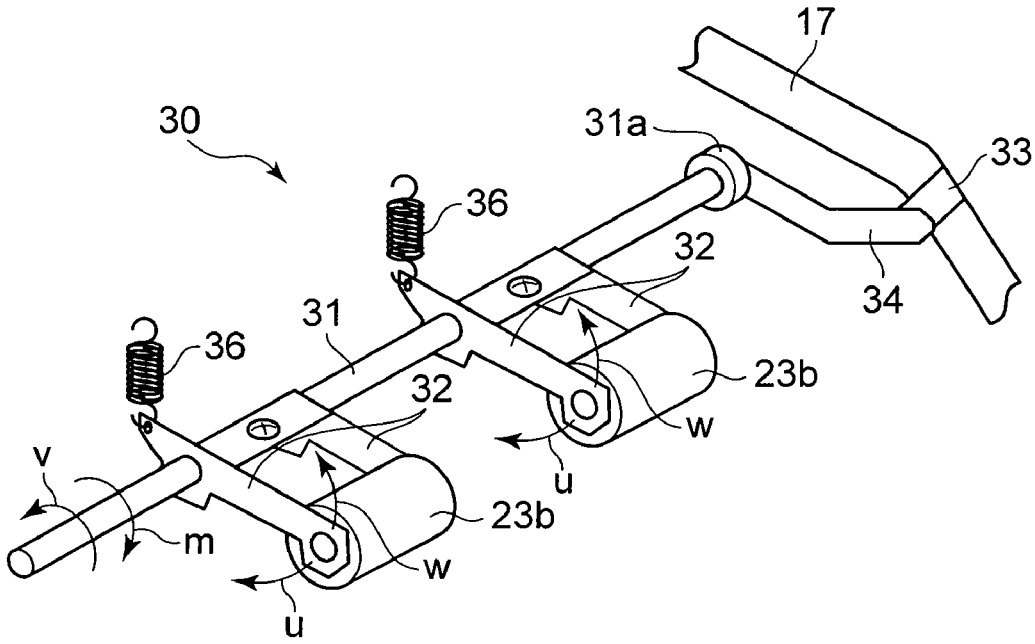
FIG. 2 is a schematic perspective view showing a lever mechanism according to the first embodiment.

As shown in FIG. 2, a lever mechanism 30 supports the upper pinch roller 23*b* by a bracket 32 fixed to a shaft 31. A rear side fulcrum 31*a* of the shaft 31 has a lever 34 including a pin 33. The pin 33 is fitted in the groove cam 17 of the inner wall of the MFP 10. A spring 36 applies a rotation force around the shaft 31 in an arrow u direction to the bracket 32.

In the state where the finisher 20 is installed to the main frame 10*a*, the pin 33 is fitted in the lower stage 17*b* of the groove cam 17 shown in FIG. 8, and the upper pinch roller 23*b* is in contact with the lower pinch roller 23*a*. When the pin 33 is fitted in the upper stage 17*c* of the groove cam 17, the lever 34 rotates the shaft 31 in an arrow v direction, and rotates the bracket 32 in an arrow w direction against the rotation force of the spring 36.

Figure 3:
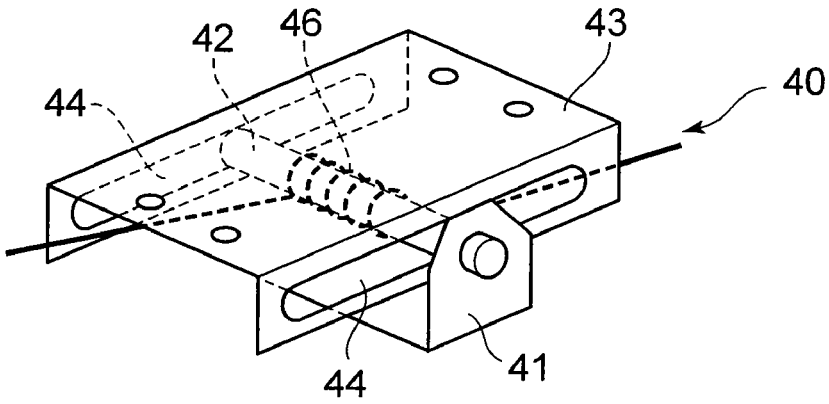
FIG. 3 is a schematic perspective view showing a hinge block according to the first embodiment.
Figure 4:
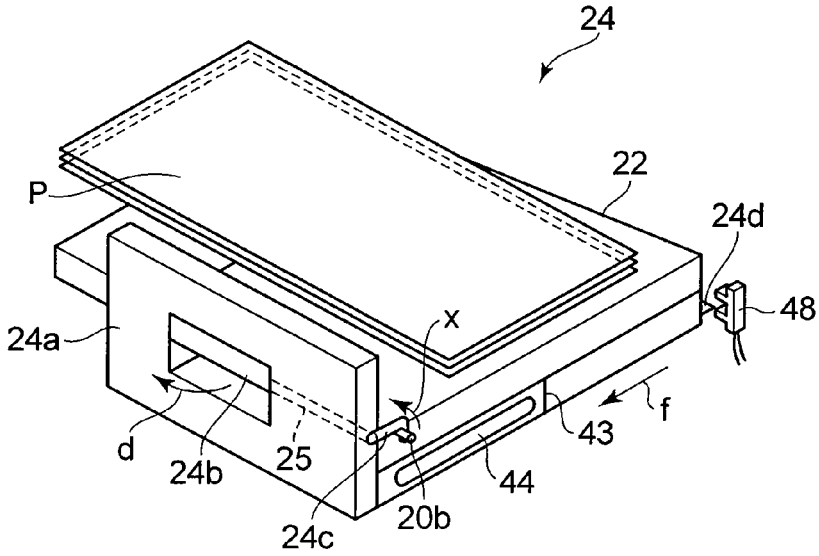
FIG. 4 is a schematic perspective view showing a tray unit according to the first embodiment.
Figure 5:
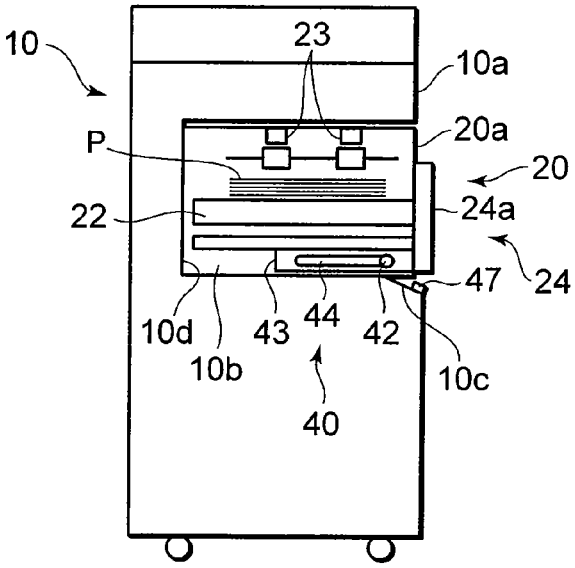
FIG. 5 is a schematic perspective view showing a state where the tray unit is installed to a frame according to the first embodiment.

In the finisher 20, in a state where the frame 20*a* is at rest in the space section 10*b*, a tray unit 24 which is a paper discharge section and has the storage tray 22 can be extracted to the front side of the MFP 10. A hinge block 40 which constitutes a support mechanism and is a slide section shown in FIG. 3 includes a rotation shaft 42 supported by a bearing 41, a base 43 having a slit 44 in which the rotation shaft 42 slides, and a hook spring 46. The frame 20*a* fixes and supports the bearing 41. The base 43 is fixed to a bottom of the tray unit 24 shown in FIG. 4. The hook spring 46 acts in a direction of pushing up the front side of the tray unit 24 while the rotation shaft 42 is used as a fulcrum. When the tray unit 24 is installed to the frame 20*a*, the rotation shaft 42 and the slit 44 of the hinge block 40 are located at a position shown in FIG. 5.

The tray unit 24 includes a front cover 24*a* at the front side. A grip 24*b* of the front cover 24*a* rotates a hook 24*c* hooked to a pin 20*b* of the frame 20*a* in an arrow x direction through a link 25. The hook 24*c* is rotated in the arrow x direction, and the connection between the frame 20*a* and the tray unit 24 is released.

The main frame 10*a* of the MFP 10 includes a tilted surface 10*c* at the front, and includes, at almost the center of the tilted surface 10*c*, a protrusion 47 which is a support mechanism and is a stand on which the bottom of the tray unit 24 extracted from the main frame 10*a* is mounted in a tilted state. The front cover 24*a* is used also as an alignment plate to align the sheet P on the storage tray 22 at the front side when the tray unit 24 extracted from the main frame 10*a* is tilted. The frame 20*a* includes a unit sensor 48 to detect installation of the tray unit 24 at the rear side. The unit sensor 48 is switched by a rear side protrusion 24*d* of the tray unit 24, and detects that the tray unit 24 is installed to the frame 20*a*.

Figure 6:
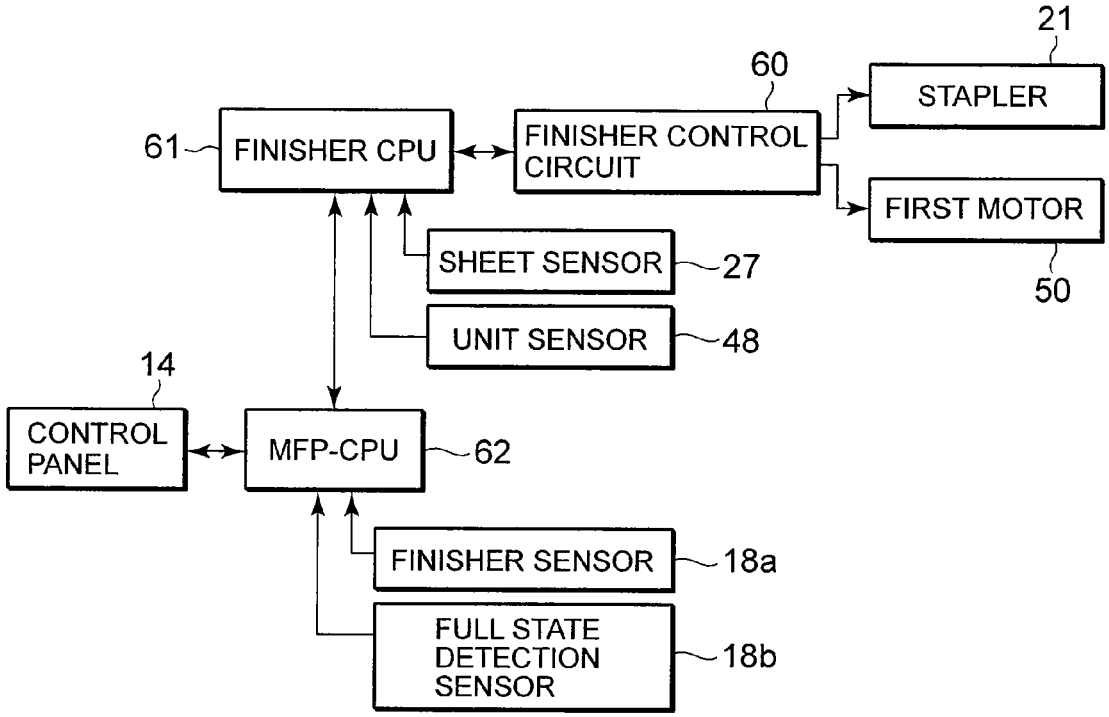
FIG. 6 is a schematic block diagram showing a control system of a finisher according to the first embodiment.

Next, a control system of the finisher 20 will be described. As shown in a block diagram of FIG. 6, a finisher control circuit 60 connects to a finisher CPU 61. The finisher CPU 61 connects to an MFP-CPU 62 to control the MFP 10. The finisher control circuit 60 controls the stapler 21, the first motor 50 and the like. The detection results of the sheet sensor 27 and the unit sensor 48 input to the finisher CPU 61. The detection results of the finisher sensor 18*a* and the full state detection sensor 18*b* input to the MFP-CPU 62.

The finisher CPU 61 is also an indication section to indicate to the MFP-CPU 62 that the conveyance of the sheet P by the pinch roller pair 23 can not be performed. When the sheet sensor 27 detects a sheet jam or when the unit sensor 48 detects extraction of the tray unit 24, the finisher CPU 61 inputs the status of the finisher 20 to the MFP-CPU 62. By the input of the status from the finisher CPU 61, the MFP 10 displays the status of the finisher 20 on the display panel 14*a*, and stops the print operation and paper discharge to the finisher 20. When the finisher sensor 18*a* detects the extraction of the finisher 20 or when the full state detection sensor 18*b* detects the full state of the storage tray 22, the MFP 10 display the extraction of the finisher 20 on the display panel 14*a*, and stops the print operation and paper discharge to the finisher 20.

Next, a description will be made on an operation of taking out a sheet P discharged from the paper discharge roller 12 to the storage tray 22 of the finisher 20 after a print operation is finished in the MFP 10. The finisher 20 pinches the sheet P discharged from the paper discharge roller 12 by the pinch roller pair 23, rotates the lower pinch roller 23*a* in the arrows direction by the first motor 50, and conveys the sheet P in the arrow r direction. The sheet P is discharged to the storage tray 22 through the stapler 21 or directly.

After the print operation is finished, the operator extracts the tray unit 24 from the space section 10*b* of the MFP 10 to the front side, and takes out the sheet P on the storage tray 22. When the grip 24*b* of the front cover 24*a* is rotated in an arrow d direction, the hook 24*c* is rotated in the arrow x direction through the link, and disengages from the pin 20*b* of the frame 20*a*. When the front cover 24*a* is further drawn to the front side, the tray unit 24 slides in an arrow f direction, while the base 43 is regulated by the rotation shaft 42 of the hinge block 40.

The unit sensor 48 turned off, and the finisher CPU 61 detects that the tray unit 24 is extracted, and notifies the status to the MFP-CPU 62. The MFP-CPU 62 displays the status that the tray unit 24 is being extracted on the display panel 14*a*, and stops a next print operation and paper discharge to the finisher 20.

Figure 7:
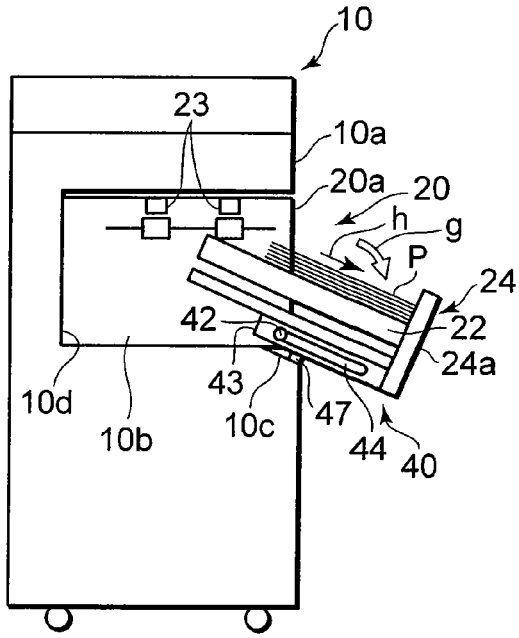
FIG. 7 is a schematic explanatory view showing a state where the tray unit according to the first embodiment is extracted.

When the rear side end of the slit 44 hits against the rotation shaft 42, the slide of the tray unit 24 in the arrow f direction is stopped. As shown in FIG. 7, the operator rotates the tray unit 24 in an arrow g direction while using the rotation shaft 42 as the fulcrum, and places it on the protrusion 47 of the tilted surface 10*c*.

The rotation shaft 42 and the protrusion 47 support the tray unit 24, so that the tray unit 24 comes to rest in the tilted state at the front side of the MFP 10. The tray unit 24 is tilted, so that the sheet P on the storage tray 22 slides in an arrow h direction. The sheet P collides with the front cover 24*a* and is aligned at the front side. After taking out the sheet P on the storage tray 22, the operator returns the tray unit 24 to the space section 10*b* of the MFP 10. When the hook 24*c* is hooked to the pin 20*b*, the unit sensor 48 detects the protrusion 24*d* and is tuned on. The finisher CPU 61 notifies the MFP-CPU 62 of the status that the tray unit 24 is installed. The MFP-CPU 62 allows the next print operation and the paper discharge to the finisher 20.

Incidentally, for example, when the number of sheets P on the storage tray 22 is small, and it is easy to take out the sheets P, the operator puts the hand into the space section 10*b* of the MFP 10 and can take out the sheets P without extracting the tray unit 24. Besides, even during the print operation, when the full state detection sensor 18*b* is tuned on, by the status from the finisher CPU 61, the MFP-CPU 62 displays, on the display panel 14*a*, the status that the storage tray 22 is full. The MFP-CPU 62 stops the next print operation and the paper discharge to the finisher 20. The operator confirms the display panel 14*a*, and similarly to the time when the print operation is finished. The operator extracts the tray unit 24 and takes out the sheets P.

Next, a description will be made on an operation of removing a sheet jam of the sheet P in the finisher 20. When the sheet jam occurs during the conveyance of the sheet P in the arrow r direction and the sheet sensor 27 detects the sheet jam, the finisher CPU 61 instructs the finisher control circuit 60 to stop the first motor 50, and notifies the status to the MFP-CPU 62. The MFP-CPU 62 displays, on the display panel 14*a*, the status of the sheet jam in the finisher 20, and stops the next print operation and the paper discharge to the finisher 20.

The operator rotates the connection lever 28 in the arrow q direction to release the connection between the main frame 10*a* and the frame 20*a*, and slides the finisher 20 in an arrow j direction as shown in FIG. 8. When the unit sensor 48 turns off, the MFP-CPU 62 displays on the display panel 14*a*, that the finisher 20 is not connected, and stops the next print operation and the paper discharge to the finisher 20.

In accordance with the slide of the finisher 20 in the arrow j direction, the pin 33 of the lever mechanism. 30 slides along the groove cam 17. In synchronization with arrival of the pin 33 at the upper stage 17*c* through the lower stage 17*b* and the slope 17*a* of the groove cam 17, the shaft 31 of the lever mechanism 30 rotates in the arrow v direction to rotate the bracket 32 in the arrow w direction, and raises the upper pinch roller 23*b*. The upper pinch roller 23*b* and the lower pinch roller 23*a* are separated from each other and the sheet P is made free.

In synchronization with the slide of the finisher 20 in the arrow j direction, the sheet P jammed in the finisher 20 remains in a space α between the MFP 10 and the finisher 20 in the state where the trailing edge is pinched by the paper discharge roller 12 of the MFP 10. The operator removes the sheet P remaining in the space α. At this time, although the paper discharge roller 12 may be in a state where the pinch is released. When one part of the sheet P is held by the paper discharge roller 12, the sheet P can be certainly made to remain in the space α, and the sheet P is more easily removed.

After the sheet jam is removed, the operator slides the finisher 20 in an arrow k direction until the connection lever 28 is hooked to the boss 16, and connects the finisher 20 to the MFP 10. In synchronization with the return of the finisher 20 in the arrow k direction, the pin 33 of the lever mechanism 30 reaches the lower stage 17*b* from the upper stage 17*c* of the groove cam 17 through the slope 17*a*. The pin 33 of the lever mechanism 30 rotates the shaft 31 of the lever mechanism 30 in an arrow m direction to rotate the bracket 32 in the arrow u direction, and lowers the upper pinch roller 23*b*. Further, the spring 36 applies a rotation force in the arrow u direction to the bracket 32, and the upper pinch roller 23*b* comes in pressure contact with the lower pinch roller 23*a*. When the finisher sensor 18*b* detects that the finisher 20 is connected to the MFP 10, the MFP-CPU 62 restarts the print operation and the paper discharge to the finisher 20.

According to the first embodiment, the tray unit 24 is extracted from the space section 10*b* of the MFP 10, and after the tray unit 24 comes to rest obliquely at the front of the MFP 10, the sheet P on the storage tray 22 can be taken out. Also when the amount of the sheets P is large, the sheets P can be easily taken out from the storage tray 22. Besides, when the sheet jam occurs in the finisher 20, along with the operation of extracting the finisher 20 from the space section 10*b* of the MFP 10, the rollers of the pinch roller pair 23 are separated from each other. The operator removes the sheet P which becomes free and remains in the space α between the MFP 10 and the finisher 20, and can easily remove the sheet jam. The removing operation of the operator when the sheet is taken out and when the sheet jam occurs is remarkably reduced.

Next, a second embodiment will be described. The second embodiment is different from the first embodiment in the structure of a tray unit. In the second embodiment, the same component as the component described in the first embodiment is denoted by the same reference numeral, and its detailed description is omitted.

Figure 9:
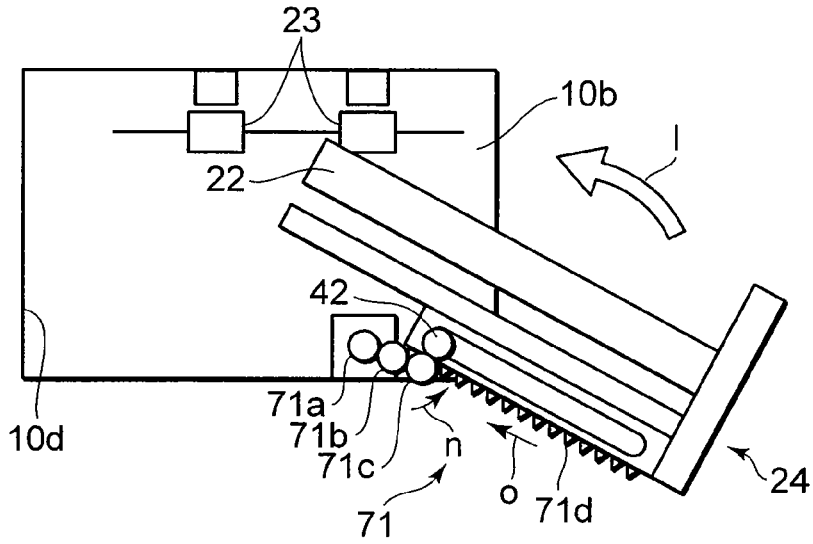
FIG. 9 is a schematic explanatory view showing a state where a finisher according to a second embodiment is automatically returned.

A tray unit 24 includes an auto-returning device 71 as a returning mechanism shown in FIG. 9. The returning device 71 includes a first pinion gear 71*c* rotated through a first link gear 71*b* by a second motor 71*a* as a driving section. Besides, the returning device 71 includes, at a bottom of the tray unit 24, a rack 71*d* engaged with the first pinion gear 71*c*.

The returning device 71 operates when the operator forgets to return the tray unit 24 after extracting the tray unit 24 to the front side and taking out the sheet P from the storage tray 22. For example, when a unit sensor 48 is not turned on even after a specified time passes since it was turned off, a finisher CPU 61 drives a second motor 71*a* to rotate the first pinion gear 71*c* in an arrow n direction. The first pinion gear 71*c* slides the tray unit 24 through the rack 71*d* in an arrow o direction. By the slide by the first pinion gear 71*c* and the rack 71*d* and the guide by a hinge block 40, the tray unit 24 is moved in an arrow l direction while the tilt is returned, and returns to a space section 10*b* of an MFP 10. When the unit sensor 48 detects a protrusion 24*d*, the second motor 71*a* is stopped.

Incidentally, when the returning device 71 operates, in order to call operator's attention, forgetting to return is displayed on a display panel 14*a*, and then, the second motor 71*a* may be driven after a specified time passes.

According to the second embodiment, similarly to the first embodiment, the sheet P on the storage tray 22 can be easily taken out. Further, even when the operator forgets to return the tray unit 24, the tray unit 24 can be automatically returned. After the tray unit 24 is extracted, it is not left as it is. The paper discharge of a next print operation is not prevented, and the safety is attained.

Next, a third embodiment will be described. The third embodiment is different from the first embodiment in the structure of a tray unit. In the third embodiment, the same component as the component described in the first embodiment is denoted by the same reference numeral and its detailed description is omitted.

Figure 10:
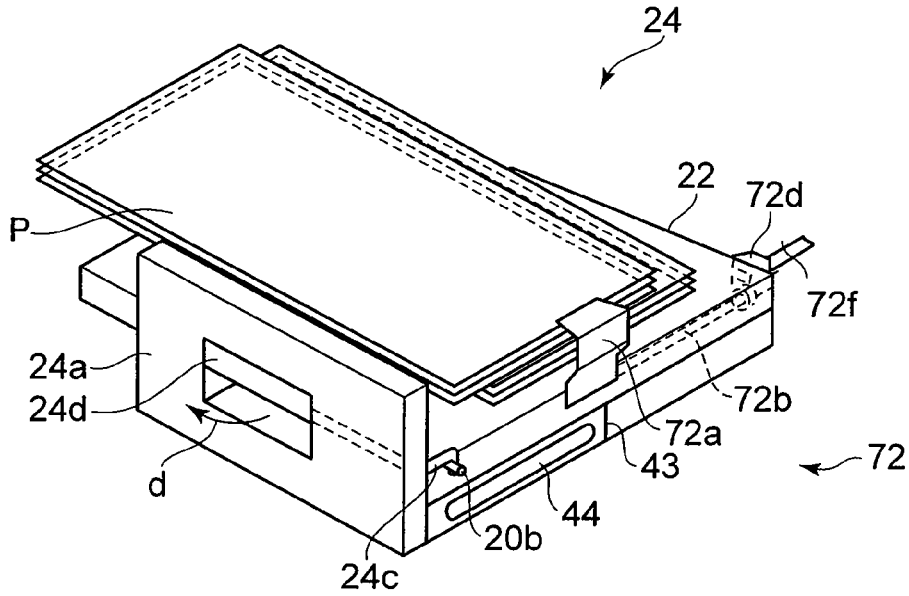
FIG. 10 is a schematic perspective view showing a tray unit according to a third embodiment.
Figure 11:
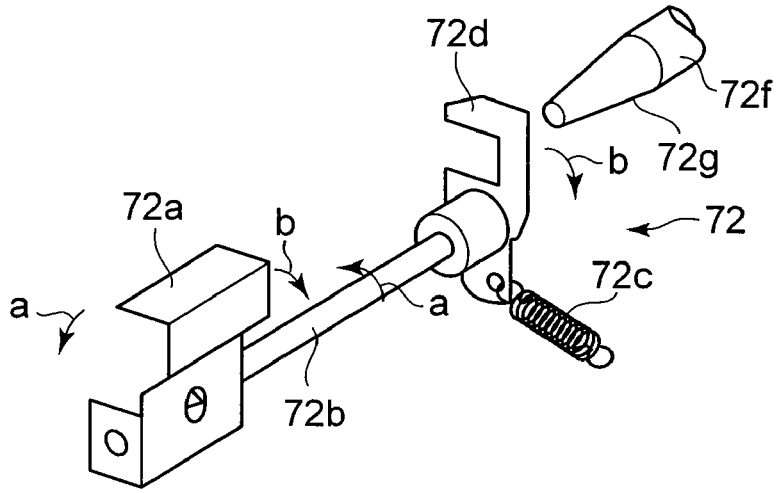
FIG. 11 is a schematic perspective view showing a sheet press device according to the third embodiment.

A tray unit 24 includes a sheet press device 72 as a hold mechanism shown in FIG. 10 and FIG. 11. The sheet press device 72 holds a sheet P on a storage tray 22 in synchronization with an operation of extracting the tray unit 24 to the front side of an MFP 10. The sheet press device 72 includes a binder 72*a* to rotate above the rear end of a storage tray 22 in a paper discharge direction, a shaft 72*b* to support the binder 72*a*, a spring section 72*c* to apply a rotation force in an arrow a direction to the shaft 72*b*, and an open gear 72*d* fixed to the rear side of the shaft 72*b*. Besides, the sheet press device 72 includes a shift pin 72*f* which is disposed on an inner wall of a space section 10*b* of a main frame 10*a*, has a tilt section 72*g* at the front end, and is fitted in the open gear 72*d*.

In the sheet press mechanism 72, when the tray unit 24 is installed to the finisher 20, the shift pin 72*f* is fitted in the open gear 72*d*. Since the rotation force of the spring section 72*c* does not act on the binder 72*a*, the binder 72*a* is separate from the storage tray 22. The sheet P discharged by a pinch roller pair 23 is accumulated on the storage tray 22 under the binder 72*a*.

When the operator extracts the tray unit 24 from the space section 10*b* of the MFP 10 to the front side in order to take out the sheet P, the shift pin 72*f* comes out of the open gear 72*d*. Since the restriction by the shift pin 72*f* disappears, the shaft 72*b* rotates in the arrow a direction by the rotation force of the spring section 72*c*, and rotates the binder 72*a* in the arrow a direction. The binder 72*a* holds the sheet P on the storage tray 22. The operator takes out the sheet in the state where it is held by the binder 72*a*, and returns the tray unit 24 to the space section 10*b* of the MFP 10.

When the tray unit 24 is returned, the front end of the shift pin 72*f* is fitted in the open gear 72*d*. The open gear 72*d* rotates in an arrow b direction along the tilt section 72*g* of the shift pin 72*f*, and rotates the binder 72*a* in the arrow b direction through the shaft 72*b*. When the tray unit 24 is installed to the frame 20*a* of the finisher 20 and a unit sensor 48 is turned on, the binder 72*a* is separated from the storage tray 22.

According to the third embodiment, similarly to the first embodiment, the sheet P on the storage tray 22 can be easily taken out. Further, in synchronization with the extraction of the tray unit 24 from the MFP 10, the sheet P on the storage tray 22 is held by the binder 72*a*, and the falling of the sheet P and the unevenness thereof can be prevented.

Next, a fourth embodiment will be described. The fourth embodiment is different from the first embodiment in the operation of a pinch roller pair 23 caused by an operation of extracting a finisher 20 from an MFP 10. In the fourth embodiment, the same component as the component described in the first embodiment is denoted by the same reference numeral and its detailed description is omitted.

Figure 12:
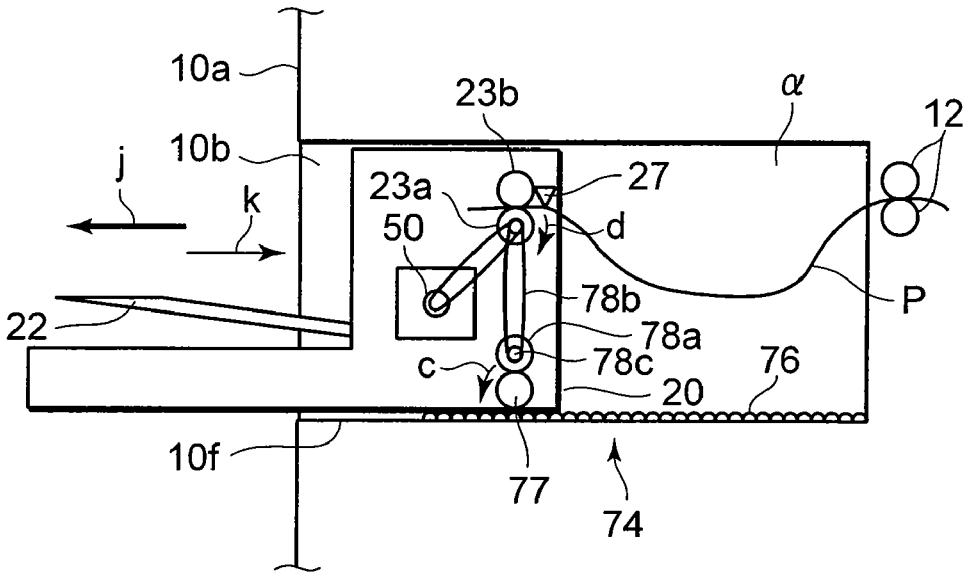
FIG. 12 is a schematic perspective view showing a roller reverse rotation device according to a fourth embodiment.
Figure 13:
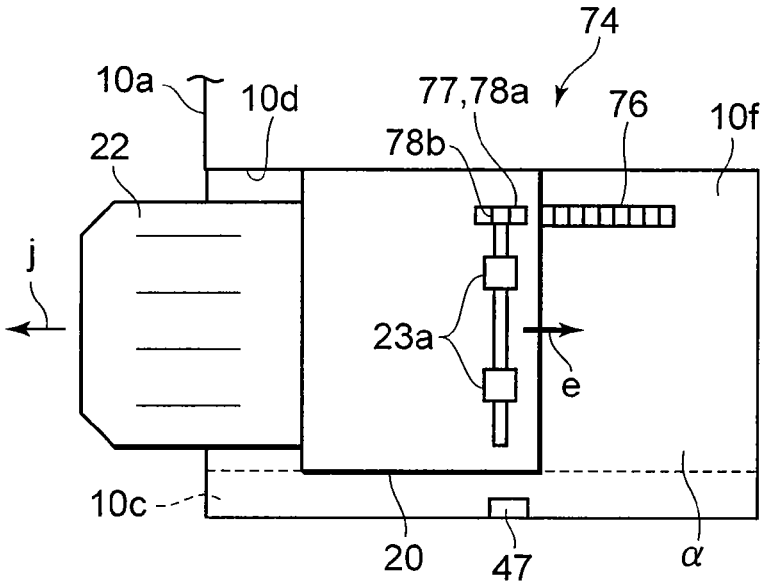
FIG. 13 is a schematic perspective view showing the arrangement of a first rack according to the fourth embodiment.

In the fourth embodiment, instead of the groove cam 17 and the lever mechanism 30 of the first embodiment, a first roller reverse rotation device 74 is provided. As shown in FIG. 12 and FIG. 13, a first rack 76 parallel to an arrow j direction as an extraction direction of a finisher 20 is provided on a bottom 10*f* of a space section 10*b* of a main frame 10*a*. A second pinion gear 77 engaged with the first rack 76 is provided on a bottom of a frame 20*a*. The second pinion gear 77 links to a lower pinch roller 23*a* through a second link gear 78*a* having a one-way clutch 78*c* and a link belt 78*b*. The first rack 76, the second pinion gear 77, the second link gear 78*a*, the link belt 78*b* and the one-way clutch 78*c* constitute a removal mechanism.

In synchronization with the sliding of the finisher 20 in the arrow j direction, the second pinion gear 77 engaged with the first rack 76 rotates in an arrow c direction. The second pinion gear 77 rotates the lower pinch roller 23*a* in a reverse direction to an arrow s direction through the second link gear 78*a* and the link belt 78*b*. By the rotation of the lower pinch roller 23*a* in the reverse direction to the arrow s direction, the pinch roller pair 23 discharges the jammed sheet P in a sheet removal direction of an arrow e direction.

The sheet P is discharged into a space α between the MFP 10 and the finisher 20 in a state where the trailing edge is pinched by a paper discharge roller 12 of the MFP 10. The operator removes the sheet P discharged into the space α. After the sheet jam is removed, the operator slides the finisher 20 in an arrow k direction until a connection lever 28 is hooked to a boss 16, and connects the finisher 20 to the MFP 10. When the finisher 20 is returned in the arrow k direction, the second pinion gear is engaged with the rack and rotates in a reverse direction to an arrow c direction. However, the second link gear 78*a* having the one-way clutch 78*c* does not transmit the rotation of the second pinion gear 77 to the lower pinch roller 23*a*.

According to the fourth embodiment, similarly to the first embodiment, the sheet P discharged into the space a is removed, so that the sheet jam can be easily removed.

Figure 14:
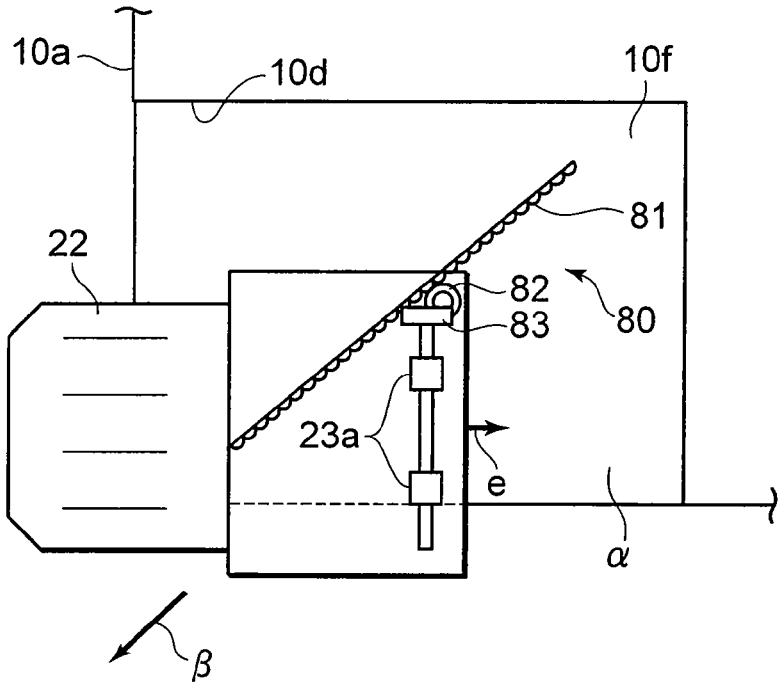
FIG. 14 is a schematic perspective view showing the arrangement of a second rack according to a modified example of the fourth embodiment.

Incidentally, as a modified example of the fourth embodiment, when the sheet jam is removed, a finisher 20 may be extracted obliquely with respect to an MFP 10. As shown in FIG. 14, in the finisher 20 extracted in an arrow β direction, a second rack 81 of a second roller reverse rotation device 80 is disposed on a bottom 10*f* of a space section 10*b* of a main frame 10*a* in parallel to the arrow β direction. A third pinion gear 82 of the second roller reverse rotation device 80 engages with the second rack 81. In synchronization with the sliding of the finisher 20 in the arrow β direction, the third pinion gear 82 rotates a lower pinch roller 23*a* in a removal direction through a third link 83. A pinch roller pair 23 discharges the jammed sheet P to a space α.

In this modified example, since the finisher 20 is extracted obliquely with respect to the MFP 10, when the sheet P is pinched by a paper discharge roller 12 and the pinch roller pair 23, there is a fear that the sheet P is twisted and is damaged in the space α. In this modified example, when the pinch of the sheet P by the paper discharge roller 12 of the MFP 10 is released at the time of detection of the sheet jam, the damage of the sheet P is suppressed, and the removing operation of the sheet jam can be further reduced.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form o the apparatus and methods described herein may be made without departing from the spirit of the inventions. The accompanying claims and there equivalents are intended to cover such forms of modifications as would fall within the scope and spirit of the invention.

What is claimed is:

1. A sheet finishing apparatus comprising:

a conveyance section that includes a pinch roller pair to pinch a recording medium and to rotate in a paper discharge direction, is disposed in a space section surrounded by peripheral walls of an image forming apparatus main body that has a paper discharge roller, and conveys the recording medium discharged by the paper discharge roller;

a frame that is positioned at a location in the space section and contains the conveyance section; and a removal mechanism that separates rollers of the pinch roller pair as the frame is being extracted from the location in the space section.

2. The apparatus of claim 1, wherein the removal mechanism includes a guide rail provided on an inner wall of the space section of the image forming apparatus, and a lever mechanism that moves along the guide rail as the frame is being extracted from the location in the space section, and separates the rollers of the pinch roller pair.

3. The apparatus of claim 2, wherein the removal mechanism includes a rack, which is parallel to an extraction direction of the frame and is provided at a bottom of the space section of the image forming apparatus, and a pinion, which engages with the rack and drives the pinch roller pair in a reverse direction relative to the paper discharge direction.

4. The apparatus of claim 2, wherein an extraction direction of the frame is parallel to a paper discharge direction of the recording medium from the conveyance section.

5. The apparatus of claim 2, further comprising a paper discharge section that is disposed outside the frame and supports the recording medium conveyed from the frame and is extracted in a direction that crosses a paper discharge direction of the recording medium from the conveyance section.

6. The apparatus of claim 1, wherein the removal mechanism rotates the pinch roller pair in a reverse direction relative to the paper discharge direction as the frame is being extracted from the location in the space section.

7. The apparatus of claim 1, further comprising a paper discharge section, which is disposed outside the frame and supports the recording medium conveyed from the frame, and a hold mechanism to hold the recording medium on the paper discharge section as the paper discharge section is being extracted from the location in the space section.

8. A sheet finishing apparatus comprising:

a conveyance section that includes a pinch roller pair to pinch a recording medium and to rotate in a paper discharge direction, is disposed in a space section surrounded by peripheral walls of an image forming apparatus main body, and conveys the recording medium discharged from the image forming apparatus;

a frame that is positioned at a location in the space section and contains the conveyance section; and a removal mechanism that includes a rack, which is parallel to an extraction direction of the frame and is provided at a bottom of the space section of the image forming apparatus, and a pinion, which engages with the rack and drives the pinch roller pair in a reverse direction relative to the paper discharge direction as the frame is being extracted from the location in the space section.

9. The apparatus of claim 8, wherein the extraction direction of the frame is parallel to a paper discharge direction of the recording medium from the conveyance section.

10. The apparatus of claim 8, further comprising a paper discharge section that is disposed outside the frame and supports the recording medium conveyed from the frame, and is extracted in a direction that crosses a paper discharge direction of the recording medium from the conveyance section.

11. The apparatus of claim 8, wherein the removal mechanism separates rollers of the pinch roller pair as the frame is being extracted from the location in the space section.

12. The apparatus of claim 8, wherein the removal mechanism includes a guide rail provided on an inner wall of the space section of the image forming apparatus and a lever mechanism that moves along the guide rail as the frame is being extracted from the location in the space section, and separates the rollers of the pinch roller pair.

13. The apparatus of claim 8, further comprising a paper discharge section, which is disposed outside the frame and supports the recording medium conveyed from the frame, and a hold mechanism to hold the recording medium on the paper discharge section as the paper discharge section is being extracted from the location in the space section.

14. A sheet jam removing method of a sheet finishing apparatus, comprising:

extracting a frame from a location in a space section of an image forming apparatus; and separating rollers of a conveyance section that is disposed in the frame as the frame is being extracted from the location in the space section.

15. The method of claim 14, further comprising retaining a recording medium that is disposed in a space between the frame and the image forming apparatus as the frame is being extracted from the location in the space section.

* * * * *